United States Patent [19]

Georgii

[11] Patent Number: 4,556,002

[45] Date of Patent: Dec. 3, 1985

[54] BUOYANT PLANT ESPECIALLY FOR THE OFF-SHORE MANUFACTURING OF CONCRETE STRUCTURES

[76] Inventor: Hans C. Georgii, Rindögatan 42, S-115 35 Stockholm, Sweden

[21] Appl. No.: 489,117

[22] Filed: Apr. 27, 1983

[30] Foreign Application Priority Data

Apr. 27, 1982 [GB] United Kingdom ..... 8212106

[51] Int. Cl.[4] ..... B63B 35/44

[52] U.S. Cl. ..... 114/264; 114/267; 114/263; 114/258

[58] Field of Search ..... 114/258, 259, 260, 261, 114/262, 263, 264, 267, 65 A, 219, 44–48; 405/204, 205

[56] References Cited

U.S. PATENT DOCUMENTS

| | | | |
|---|---|---|---|
| 1,804,667 | 5/1931 | Bitte | 114/258 |
| 1,896,546 | 2/1933 | Kulik | 114/261 |
| 2,408,871 | 10/1946 | Nelson | 114/258 |
| 3,133,518 | 5/1964 | Burnett | 114/47 |
| 3,327,670 | 6/1967 | Burnett | 114/47 |
| 3,686,886 | 8/1972 | George, II | 114/264 |
| 3,848,558 | 11/1974 | Henry | 114/261 |
| 3,890,916 | 6/1975 | Tummers | 114/219 |
| 4,069,785 | 1/1978 | Bordes | 114/258 |
| 4,070,979 | 1/1978 | Otis | 114/267 |
| 4,084,529 | 4/1978 | Katernberg | 114/267 |
| 4,190,013 | 2/1980 | Otis | 114/267 |
| 4,325,653 | 4/1982 | Teasdale | 114/267 |

*Primary Examiner*—Trygve M. Blix

*Assistant Examiner*—C. T. Bartz

*Attorney, Agent, or Firm*—McAulay, Fields, Fisher, Goldstein & Nissen

[57] ABSTRACT

A buoyant plant especially for the off-shore manufacturing of concrete structures, as e.g. oil platforms, comprises two substantially parallel, spaced, elongated side sections 1,2, a roof sections 3 extending from the forward to the backward ends of said sections and connecting the top of said side sections to each other, a stem section connected to the forward ends of said side and roof sections, a substantially rectangular bottom section 5, the forward short side end of which is connected to said stem section and the backward short side end of which is situated spaced apart forwardly of the backward ends of said side sections, said bottom section being connected along its long side ends to the lower parts of said side sections, and a buoyant stern section 6 situated, and connectable and disconnectable, respectively, in the opening between said roof and side sections, said stern section 6 extending from the inner face of one side section to the other. Thereby, the stern section 6 is connectable to and disconnectable from, respectively, the backward part of said side sections at a distance from said bottom section to leave a free opening downwardly therebetween. At least one of said side sections 1,2 can have at one end thereof a docking unit for receiving ships and the like which is provided with port means to enclose completely a ship in said side section at a docking operation. At least one wave protecting means can be provided along one of the outer faces of said side sections.

20 Claims, 3 Drawing Figures

BUOYANT PLANT ESPECIALLY FOR THE OFF-SHORE MANUFACTURING OF CONCRETE STRUCTURES

The invention relates to a buoyant plant preferably for the off-shore manufacture of concrete structures (Hydro Concrete System), as e.g. oil platforms.

From U.S. Pat. No. 3,686,886 a plant for manufacturing of concrete structures in open unsheltered waters is previously known, e.g. a construction such as disclosed in U.S. Pat. Nos. 3,249,664 and 3,537,268.

Moreover, the plant according to U.S. Pat. No. 3,686,886 has a great disadvantage in that it is associated with serious problems in removing a manufactured structure from the plant. As it is described in the above patent specification, one way to remove it is to tilt the plant and in the tilted position remove the structure therefrom. Of course there is a great danger in tilting the whole construction, even if it is anchored to the sea bottom, and also it makes it more comfortable for the persons working on the plant if the tilting problem is eliminated. Another embodiment of such a plant is shown in the above U.S. Pat. No. 3,686,886 in which an opening is present in the plant through which a manufactured construction can be removed therefrom. However, in this embodiment a problem, also described in the above patent specification, is that you can only use this plant in sheltered waters. A further problem with known plant of this kind is the transport of raw materials to and from the manufacturing plant, and the storing of the same thereon.

With these drawbacks in view, the main object of the invention is therefore to provide a plant which permits the off-shore manufacture of concrete structures in open substantially unsheltered waters, and make it possible to provide easy and economical transport of raw materials and staff to and from said plant.

This object is obtained by a plant comprising:

two substantially parallel, spaced, elongated side sections, a roof section extending from the forward to the backward ends of said sections and connecting the top of said side sections to each other, a stem section connected to the forward ends of said side and roof sections, a substantially rectangular bottom section, the forward short side end of which is connected to said stem section and the backward short side end of which is situated spaced apart forwardly of the backward ends of said side sections, said bottom section being connected along its long side ends to the lower parts of said side sections, and a buoyant stern section situated, and connectable and disconnectable, respectively, in the opening between said roof and side sections, said stern section extending from the inner face of one side section to the other, whereby said stern section is connectable to and disconnectable from, respectively, the backward part of said side sections at a distance from said bottom section to leave a downwardly facing free opening therebetween.

Other objects are obtained by the construction illustrated in the accompanying drawings and described below. It is to be understood that the invention is not restricted to the particular form thereof shown and described.

Figure 1:
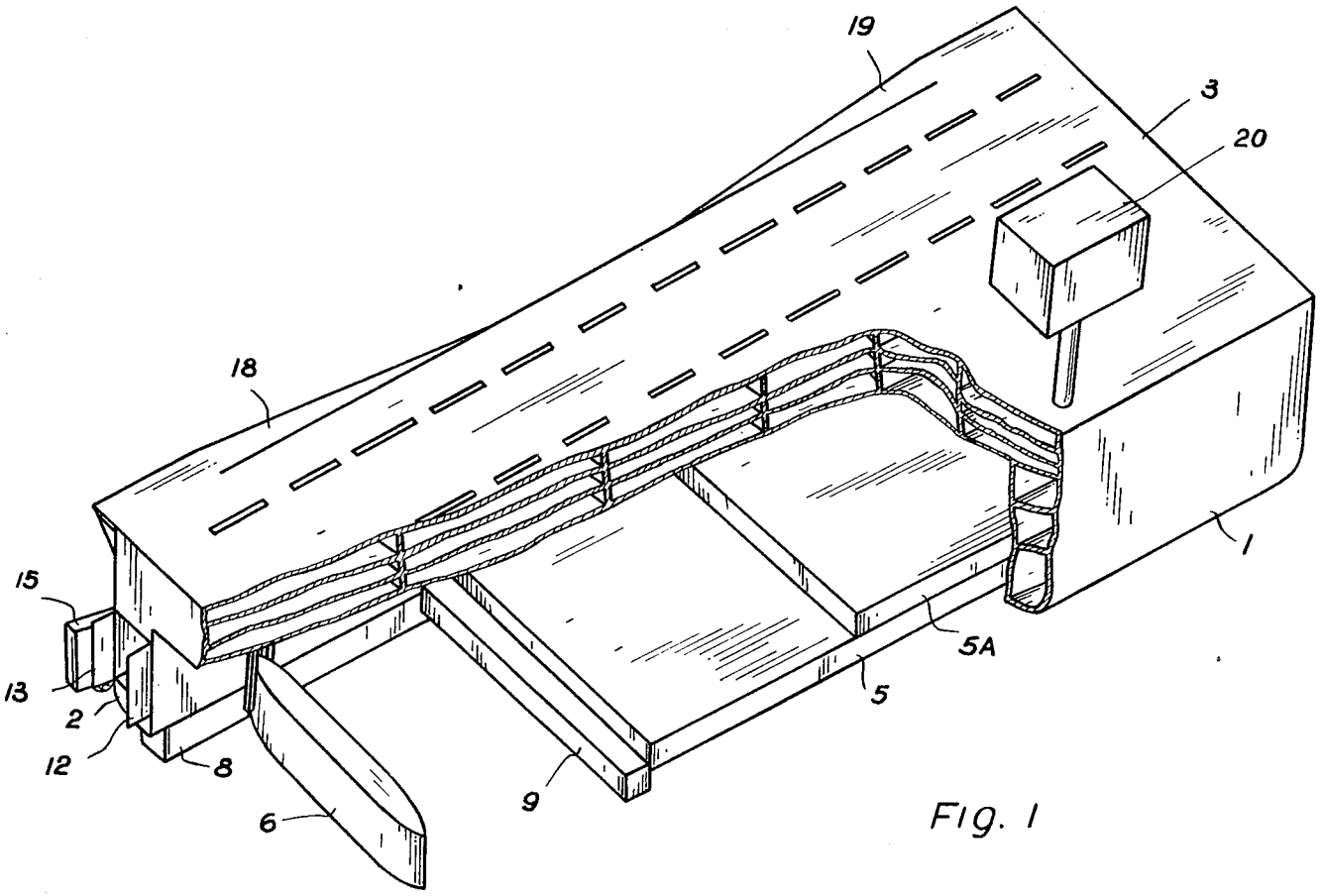
FIG. 1 is a schematic perspective view of a plant according to the invention shown by way of example.
Figure 2:
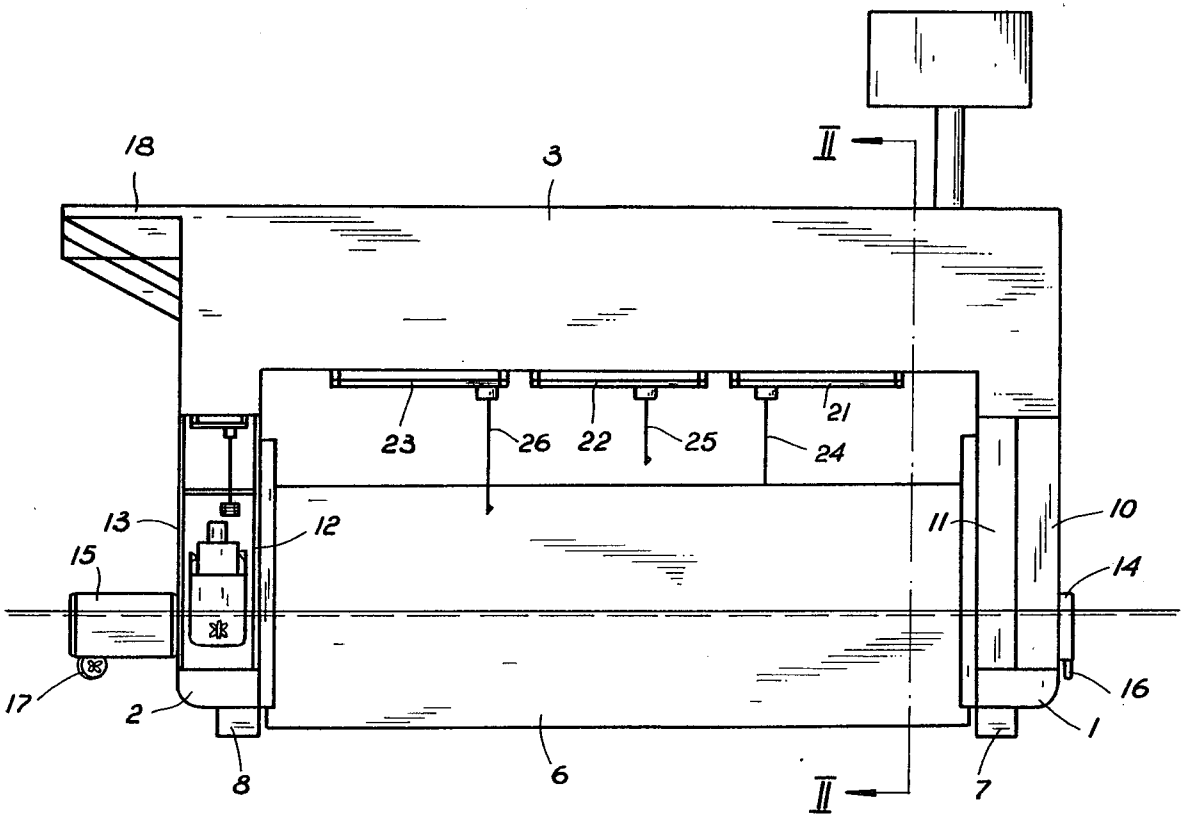
FIG. 2 is an end view of the same plant.
Figure 3:
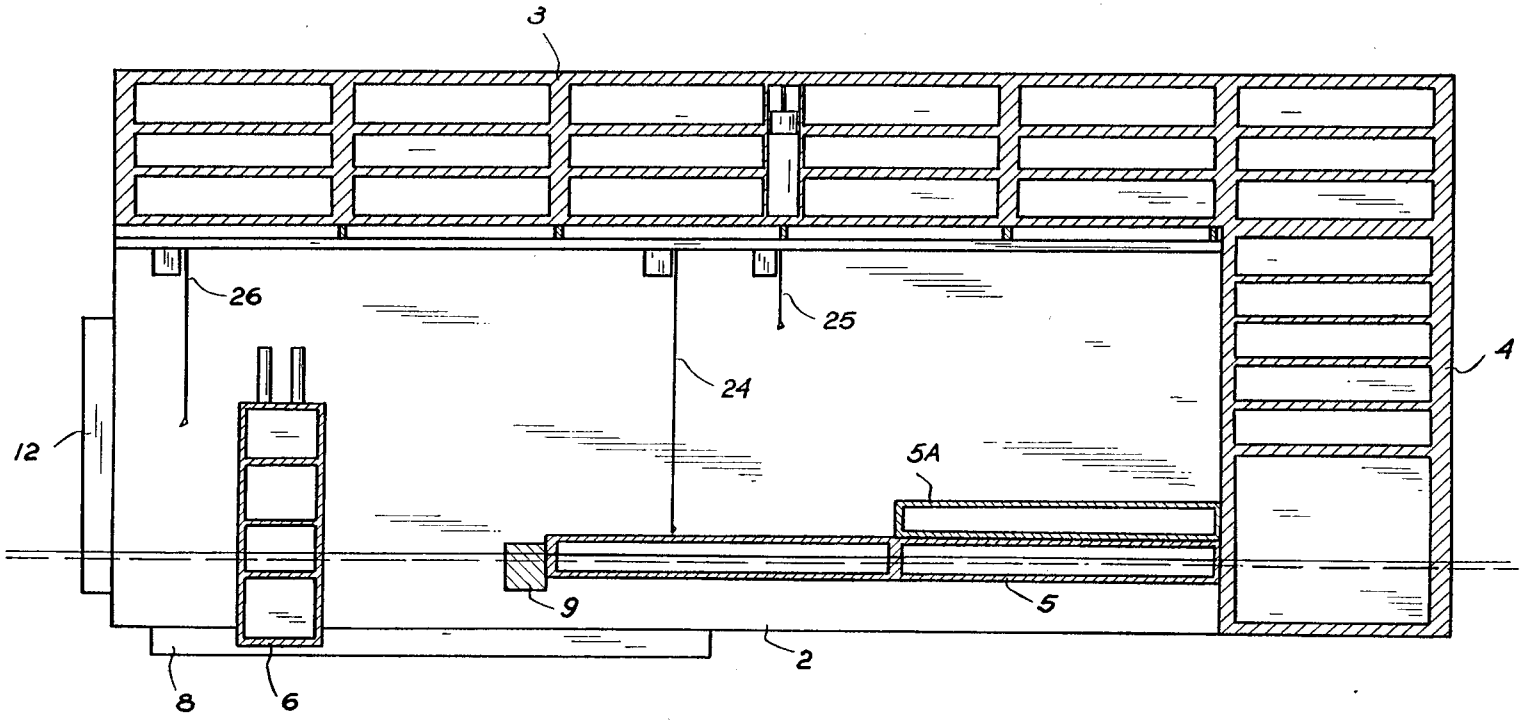
FIG. 3 is a longitudinal section through the plant along the line II—II in FIG. 2.

A buoyant plant schematically shown in FIGS. 1-3 comprises two substantially parallel, spaced, elongated side sections 1, 2 and a roof section 3 extending from the forward to the backward ends of said side sections and connecting the top of said side sections to each other. A stem section 4 (FIG. 3) is connected to the forward ends of said side and roof sections. A substantially rectangular bottom section 5 has its forward short side end connected to the stem section and its backward short side end situated spaced apart forwardly of the backward ends of said side sections. The bottom section is connected along its long side ends to the lower parts of said sections. A buoyant stern section 6 is situated, and connectable and disconnectable, respectively, in the opening between said roof and side sections. The stern section extends from the inner face of one side section to the other (FIG. 2). Thereby the stern section can be connected and disconnected, respectively, at the backward part of said side sections at a distance from said bottom section to leave a free opening facing downwardly therebetween.

The plant according to the invention has been formed to meet specific functional demands. All demands assume that transport from and to, respectively, the plant shall be carried out by air or by sea. The staff on the plant will spend long periods of time on board in a comfortable and pleasant way.

The plant hull described above is built up of ballast and trimming tanks which can be filled with water to a variable extent, whereby the buoyancy and thereby the flotation height can be determined and controlled. These ballast tanks are provided over at least the whole bottom section, and preferably also in the side sections. The whole plant can be lowered with regard to the water line by filling the ballast tanks so that water enters over the main platform of the bottom section, i.e. the lowest part of the bottom section; the lowest section of the bottom section can be connected to the opening between the bottom section and the stern section whereupon concrete structures manufactured on the bottom section can be launched into the sea and transported in an easier way to the basin between the stern section and the bottom section. This basin or opening is directly connected to the sea on the outside of said plant. When moving a complete structure from the basin or opening to the outside of the plant the stern section is disconnected from the side sections and moved out from the stern opening of the plant whereafter the completed concrete structure can be released from the plant. The stern section can be connected to the side section inner surfaces by any appropriate coupling means. In the preferred embodiment shown in the drawings the stern and stem of said stern section are fixed between beams or the like allowing the stern section to move upwardly and downwardly relative the rest of the plant.

The bottom section can also be so constructed that it or a part of it can be raised and lowered with regard to the other parts of said plant.

The upper platform part 5A of the bottom section 5, where usually material and manufacturing equipment are placed, can be disconnected and is formed in the same way as the rest of the bottom of the platform. It can be launched out into the basin opening at the stern end of the plant and there be sunk and fixed on a predetermined level and serve as a bottom thereby obtaining a floating dock which can receive most of the vessels constructed and manufactured today. As seen in the drawings the upper platform part 5A as well as the bottom section 5 are provided with ballast tanks.

The hull sides or the side sections preferably have volumes such that they can have various facilities. The stern section which is buoyant functions as a removable "port" which by means of said coupling means and thrusters can be removed and put back into place. Alternatively, the stem section can also be constructed like the stern section, i.e. as a removable buoyant structure.

The plant according to the invention can be moved on the sea by means of drive means (not shown) and propellers or the like (not shown) connected thereto.

The roof section consists of a self-supporting structure on at least two levels or decks which spans over and between the hull or side sections and also over the stem and stern sections. In the present embodiment the roof section has one upper deck and four inner decks, which can be used in many ways. Of course the number of decks in said roof section can be altered as desired.

Said basin at the stern of the plant is protected from outer wave movements on one hand by deeper bottom side sections 7, 8, and on the other hand by a platform 9 which can be lowered and which is situated between the bottom section and the basin. The movable platform 9 can also be used for small sea launching operations without requiring the whole plant to be lowered by filling the ballast tanks in the side sections and the bottom section with water.

In a modified embodiment of the present invention the whole bottom section can be lowered and raised relative to the side sections, stem section and roof section of the plant. In this particular case the bottom section is arranged on the inner walls of the side sections, and said stem section by means of guide means which allow the bottom section to be lowered and raised relative to the side sections and the stem section, and to be locked into place on different levels. In this particular embodiment the bottom section is preferably provided with ballast tanks and the lowering and raising operations can be achieved by means of drive means which can be controlled to move the bottom section upwardly and downwardly, simultaneously as the ballast tanks are filled and emptied, respectively.

Transport to and from said plant at sea can be performed with different types of ships. The normal transport of materials, containers, sand, cement and reinforcement irons for manufacturing concrete structures is effected by fast ships of about 40,000 tdw which can be docked into the hull or side sections as can be seen in the drawings. The side sections are provided with ports 10, 11 and 12, 13. As can be seen in FIG. 2, the left side section 2 has such a docking department with the ports 12, 13 being open and a ship being received therein. After the ship has docked in, the ports 12, 13 can be closed to protect the ship from sea movements during unloading and loading operations.

Outside of the side sections there are provided two wave protecting members 14 and 15, respectively. These members consist of floating beams which are hinged to the outer side face of the side sections. Said wave protecting members are provided with drive means 16 and 17, respectively, with the aid of which said floating beams can be turned out to other positions, as to the position shown by the left floating beam 15 in FIG. 2, thereby protecting the stern face of the plant from waves and currents when a ship is going to be docked inside a side section.

A larger ship can be put into the outer face of the buoyant stern section 6 between the hull or side sections.

Hence, the harbour terminals which are provided on the plant according to the invention provide all the requirements for the handling of goods which hardly any on-shore based industry can rival for economy and effectiveness.

The upper deck above the roof section is on a height level about 80 meters above the water line. It can have a length of 800 meters and a width of about 260 meters. On the roof section two runways for aeroplanes are provided and also arrangements for taking care of aeroplanes and helicopters. Two ramps 18, 19 lead down under the deck surface to the next deck which can be built up as a hangar. Air traffic control is obtained by providing at least one tower 20 on top of the deck. On the level directly under the top deck not only hangar spaces for aeroplanes and helicopters can be arranged, but also service spaces and workshops. Other parts of the roof section can be used for the staff on board as shopping centres, recreation centres, restaurants, cinemas etc.

Alternatively the ramp or ramps, instead of being formed as a structure arranged on the outside of one side section, can be provided extending through the body of the top deck to the level directly under.

The runway for aeroplanes on said plant can always be provided against or with the prevailing wind direction and at a great height. This facilitates take-off and landing on the deck. Several standard aeroplanes can operate from such a runway. Thereby expensive helicopter transport can be obviated. Helicopter transport unfavourably affects the economies of conventional off-shore handling. In the concrete casting compartment which is defined by the space between the bottom section, the roof section, the side sections, the stem section and the stern section, the manufacture of off-shore concrete structures can be performed, also in certain industry areas in the hull sections where in addition at least one concrete station with storing compartments is situated.

On the underside of the roof section three traverse travelling cranes 21, 22 and 23 are arranged which have lifting equipment 24, 25 and 26, respectively.

As can be seen in the drawings the traverse cranes can reach over the stern section 6 to load or unload a ship which is docked outside of the stern section.

Sliding form casting operations can be effected in the basin and the manufacturing of bottom pieces in the centre part of the casting compartment. The forward higher part of the casting compartment is used for storing casting moulds, cranes, transporting devices, reinforcement irons and other equipment which is needed on a concrete casting working place.

The manufacturing process is highly automatable and a series of transporting devices can be used. Ramps and lifts connect the different levels with each other.

The invention can be modified within the scope of the accompanying claims.

I claim:

1. A buoyant plant preferably for the off-shore manufacture of concrete structures, e.g., oil platforms, said plant comprising:

two substantially parallel, spaced, elongated side sections;

one of said side sections including a docking unit for receiving ships and the like;

port means provided in said docking unit which can be opened and closed to enclose completely a ship in said side section during a docking operation;

a roof section extending from the forward to the backward ends of said sections and connecting the top of said side sections to each other;

a stem section connected to the forward ends of said side and roof sections;

a substantially rectangular bottom section, the forward short side end of which is connected to said stem section and the backward short side end of which is situated spaced apart forwardly of the backward ends of said side sections, said bottom section being connected along its long side ends to the lower parts of said side section;

a buoyant stern section situated, and connectable and disconnectable, respectively, in the opening between said roof and said side sections, said stern section extending from the inner face of one said side section to the other, whereby said stern section is connectable to and disconnectable from, respectively, the backward part of said side sections at a distance from said bottom section to leave a downwardly facing free opening therebetween; and a separate extending platform provided at the backward end of said bottom section, said platform being movable above and below, respectively, the water line.

2. A plant according to claim 1, wherein said bottom section comprises at least two decks on different levels, the lowest of which is situated closest to said free opening, and said ballast means includes at least one ballast tank for each said decks which can be filled and emptied, respectively, to raise or lower both said decks above and below, respectively, the water line.

3. A plant according to claim 1, wherein at least one wave protecting means is provided along one of the outer faces of said side sections, said wave protecting means comprising an elongated part which is hinged on said side section and which can be turned to different positions in the horizontal plane and fixed in these positions.

4. A plant according to claim 3, wherein said wave protecting means are provided at the backward part of the outside of each side section to protect the stern opening against unsheltered sea.

5. A plant according to claim 1, wherein at least one traverse travelling crane is provided on the underside of said roof section, said travelling crane extending past said stern section and substantially to the backward end edge of said roof section, and wherein said stern section is connectable and disconnectable, respectively, in a position at such a distance from the backward end of said roof section that a ship can put in against the outer side of said stern section and in this position can be unloaded and loaded, respectively, by means of said travelling crane.

6. A plant according to claim 1, wherein said bottom section comprises at least two decks on different levels, the lowest of which is situated closest to said free opening, and said ballast tank means includes at least one ballast tank which can be filled and emptied, respectively, to raise or lower at least said upper deck above and below, respectively, the water line.

7. A plant according to claim 1, wherein said roof section comprises at least two parallel decks on different levels, there being a ramp between the upper deck and the next lower deck whereby an aeroplane hangar is provided in the compartment between said decks, and wherein an air traffic control terminal is provided.

8. A plant according to claim 7, wherein said ramp extends through the body of the upper deck to the deck directly thereunder.

9. A plant according to claim 1, wherein said ramp is provided on the outer side of and extends along one of said side sections.

10. A buoyant plant preferably for the off-shore manufacture of concrete structures, e.g., oil platforms, said plant comprising:

two substantially parallel spaced, elongated side sections;

a roof section extending from the forward to the backward ends of said sections and connecting the top of said side sections to each other;

a stem section connected to the forward ends of said side and roof sections;

a substantially rectangular bottom including a movable bottom section, the forward short end of which is connected to said stem section and the backward short end of which is situated spaced apart forwardly of the backward ends of said side sections, said bottom section being connected along its long side ends to the lower parts of said side sections;

a bouyant stern section situated, and connectable and disconnectable, respectively, in the opening between said roof and side sections, said stern section extending from the inner face of one side section to the other, whereby said stern section is connectable to and disconnectable from, respectively, the backward part of said side sections at a distance from said bottom section to leave a downwardly facing free opening therebetween;

said bottom section comprising at least two decks on different levels, the lowest of which is situated closest to said free opening; and ballast means associated with said movable bottom section for raising and lowering at least said lowest deck with respect to side sections and the water line.

11. A plant according to claim 10, including a separately extending movable platform at the backward end of said bottom section, said platform being movable above and below, respectively, the water line, preferably along the short side edge of said bottom section.

12. A plant according to claim 10, said roof section comprising at least two parallel decks on different levels, a ramp between the upper deck and the next lower deck, an aeroplane hangar provided in the compartment between said decks, and an air traffic control terminal on one of said parallel decks.

13. A plant according to claim 12, wherein said ramp is provided on the outer side of and extends along one of said side sections.

14. A plant according to claim 10, wherein at least one of said side sections at one end thereof includes a docking unit for receiving ships and the like, and port means associated with said docking unit to enclose completely a ship in said side section during a docking operation.

15. A plant according to claim 10, wherein said ballast means includes at least one ballast tank for each said decks which can be filled and emptied, respectively, to raise or lower both decks above and below, respectively, the water line.

16. A buoyant plant preferably for the off-shore manufacture of concrete structures, e.g., oil platforms, said plant comprising:

two substantially parallel, spaced, elongated side sections;

a roof section extending from the forward to the backward ends of said sections and connecting the top of said side sections to each other;

a stem section connected to the forward ends of said side and roof sections;

a substantially rectangular bottom section, the forward short side end of which is connected to said stem section and the backward short side end of which is situated spaced apart forwardly of the backward ends of said side sections, said bottom section being connected along its long side ends to the lower parts of said side sections;

said bottom section comprising at least two decks on different levels, the lowest of which is situated closest to said free opening, one of said decks being movable, and at least one ballast tank provided for said movable deck which can be filled and emptied, respectively, to raise or lower said movable deck above and below, respectively, the water line; and a buoyant stern section situated, and connectable and disconnectable, respectively, in the opening between said roof and side sections, said stern section extending from the inner face of one side section to the other, whereby said stern section is connectable to and disconnectable from, respectively, the backward part of said side sections at a distance from said bottom section to leave a downwardly free opening therebetween.

17. A plant according to claim 16, including a separately extending movable platform at the backward end of said bottom section, said platform being movable above and below, respectively, the water line, preferably along the short side edge of said bottom section.

18. A plant according to claim 16, including at least one wave protecting means along one of the outer faces of said side sections, said wave protecting means comprising an elongated part which is hinged on said side section and which can be turned to different positions in the horizontal plane and fixed in these positions.

19. A plant according to claim 18, wherein said wave protecting means are provided at the backward part of the outside of each side section to protect the stern opening against unsheltered sea.

20. A plant according to claim 16, wherein said roof section comprises at least two parallel decks on different levels, at least one ramp between the upper deck and the next lower deck on the outer side of and extending along one of said side sections, an aeroplane hangar provided in the compartment between said decks, and an air traffic control terminal.

* * * * *